US006648203B2

(12) United States Patent
Lord

(10) Patent No.: US 6,648,203 B2
(45) Date of Patent: Nov. 18, 2003

(54) TOOL FOR IMPROVING THE DECORATIVE UPHOLSTERY TACKING PROCESS

(76) Inventor: Steven Douglas Lord, 624 Mercer St., Reading, PA (US) 19601

( * ) Notice: Subject to any disclaimer, the term of this patent is extended or adjusted under 35 U.S.C. 154(b) by 90 days.

(21) Appl. No.: 09/925,875

(22) Filed: Aug. 7, 2001

(65) Prior Publication Data

US 2002/0030080 A1 Mar. 14, 2002

Related U.S. Application Data

(60) Provisional application No. 60/224,018, filed on Aug. 10, 2000.

(51) Int. Cl.[7] ..... B25C 7/00
(52) U.S. Cl. ..... 227/147; 81/44
(58) Field of Search ..... 227/147; 81/44

(56) References Cited

U.S. PATENT DOCUMENTS

| | | | | | |
|---|---|---|---|---|---|
| 350,420 | A | * | 10/1886 | Dillon | 227/147 |
| 493,758 | A | * | 3/1893 | Davidson | 227/147 |
| 608,555 | A | * | 8/1898 | Nazel | 227/147 |
| 620,426 | A | | 2/1899 | Danzer | |
| 746,549 | A | * | 12/1903 | Modlin et al. | 227/147 |
| 1,127,838 | A | * | 2/1915 | Willers | 227/147 |
| 1,164,086 | A | * | 12/1915 | Gooding | 227/147 |
| 1,465,139 | A | * | 8/1923 | Long | 227/147 |
| 2,094,459 | A | | 9/1937 | Lipson | 1/47 |
| 2,430,532 | A | * | 11/1947 | Rayburn | 227/147 |
| 2,533,112 | A | | 12/1950 | Hayden | 1/47 |
| 2,780,811 | A | | 2/1957 | Rodin | 1/47 |
| 2,929,067 | A | | 3/1960 | Tupta | 1/47 |
| 3,008,361 | A | * | 11/1961 | Henning | 227/147 |
| 3,061,835 | A | * | 11/1962 | Hain | 227/147 |
| 3,218,030 | A | * | 11/1965 | Baro | 227/147 |
| 3,381,551 | A | * | 5/1968 | Lavering et al. | 227/147 |
| 3,549,075 | A | | 12/1970 | Tsunemi | 227/63 |
| 3,716,088 | A | | 2/1973 | Gray | 145/46 |
| 3,764,054 | A | | 10/1973 | Monacelli | 227/114 |
| 4,029,135 | A | | 6/1977 | Searfoss | 145/46 |
| 4,061,225 | A | * | 12/1977 | Pettitt | 206/230 |
| 4,132,409 | A | * | 1/1979 | Taylor | 463/47.6 |
| 4,263,903 | A | * | 4/1981 | Griggs | 227/147 |
| 4,610,188 | A | * | 9/1986 | Hallock | 81/24 |
| 4,676,424 | A | | 6/1987 | Meador | 227/147 |
| 4,709,765 | A | | 12/1987 | Campanell | 173/119 |
| 4,881,676 | A | | 11/1989 | St. Peter | 227/63 |
| 4,903,882 | A | | 2/1990 | Long | 227/147 |
| D378,981 | S | | 4/1997 | Alexander | D8/51 |

* cited by examiner

*Primary Examiner*—Scott A. Smith
*Assistant Examiner*—Louis Tran

(57) ABSTRACT

An upholstery tack holding tool is formed with a shaft having a concave gripping surface formed transversely into the shaft. The concave gripping surface terminates in a circumferential lip that encircles a longitudinally extending concave tack receiving area at one end of the shaft opposite the flat top surface adapted for striking by a tack hammer. The tools improves control, stability, and speed of operation by enabling the operator to simultaneously grasp the lip of the tool and the head of the tack to hold the tack against the concave tack receiving portion while being inserted into the desired surface.

13 Claims, 1 Drawing Sheet

TOOL FOR IMPROVING THE DECORATIVE UPHOLSTERY TACKING PROCESS

CROSS-REFERENCE TO RELATED APPLICATIONS

This application claims domestic priority of U.S. Provisional Patent Application Serial No. 60/224,018, filed Aug. 10, 2000, the contents of which are hereby incorporated herein by reference.

BACKGROUND OF THE INVENTION

This invention relates to a tool for improving the decorative upholstery tacking process. Historically, decorative upholstery tacks were driven into the desired surface by the practitioner holding the tack with his fingers and then hammering the tack with a tack hammer. Typically, the practitioner will strike his fingers with the hammer. No known commercial tool to assist in the upholstery tacking process to solve the problem of exposing the fingers to impact with the operating tack hammer could be found in the marketplace. Providing such a tool would enhance the upholstery tacking process and provide an improved measure of control and stability in the insertion of upholstery tacks into the desired surface.

Some tools to address the problem of holding and stabilizing a tack were identified in a search, including U.S. Pat. No. 608,555 (Nazel); U.S. Pat. No. 2,049,459 (Lipson); U.S. Pat. No. 2,666,201 (Van Orden); U.S. Pat. No. 2,780,811 (Rodin); U.S. Pat. No. 3,218,030 (Baro); U.S. Pat. No. 3,549,075 (Tsunami); U.S. Pat. No. 3,716,088 (Grey); U.S. Pat. No. 3,764,054 (Monacelli); U.S. Pat. No. 4,029,135 Searfoss, Jr.); U.S. Pat. No. 4,061,225 (Pettitt); U.S. Pat. No. 4,676,424 (Meadow); and U.S. Pat. No. 4,709,765 (Campanelli). None of these patents provide the teaching for a tool that will enhance the upholstery tacking process and improve the control and stability of inserting an upholstery tack in the desired surface. While some of the aforementioned patents do incorporate elements of my upholstery tacking tool, such as a shaft and a concave area at the end of the tool to receive the tack to be inserted, most of the tools disclosed in the above-identified prior art patents utilized magnets and intricate slits to fit tacks or nails. It would be desirable to provide a tool for improving the upholstery tacking process that would permit the simultaneous grasping of the tack and the end of the tool with the practitioner's fingers so that only the practitioner's fingers and the outside shape of the tool will be required to hold the tack in place before striking the tool with a tacking hammer to insert the upholstery tack into the desired location.

SUMMARY OF THE INVENTION

In summary, the instant invention will improve the decorative upholstery tacking process by keeping the fingers away from the driving force due to the use of the upholstery tacking tool incorporating the principles of the present invention.

It is an important object of this invention that the upholstery tacking tool and the decorative upholstery tack being inserted into the desired surface will be held simultaneously by the practitioner's finger before inserting the upholstery tack into the desired location.

It is an advantage of this invention that the upholstery tacking tool incorporating the principles of the instant invention will enhance safety, significantly improve control and stability of the upholstery tack before being inserted into the desired surface, and substantially decrease the time required for inserting upholstery tacks into furniture and other devices for which upholstery tacks are required.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
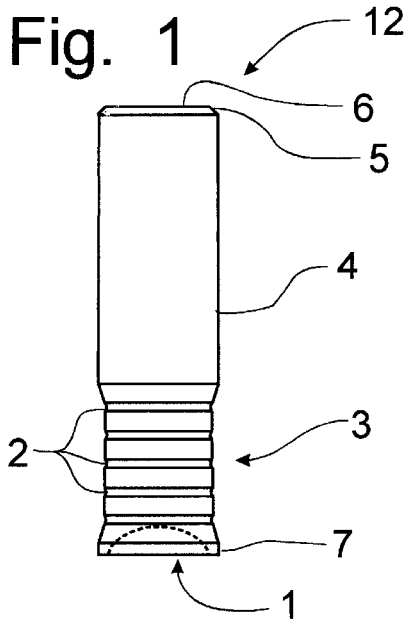
FIG. 1 is an elevational view of an upholstery tacking tool incorporating the principles of the instant invention, the internal concave area at the tack-engaging end of the tool being depicted in phantom.
Figure 3:
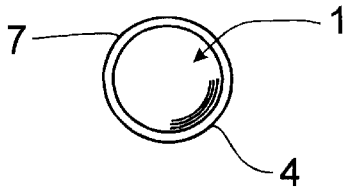
FIG. 3 is an end view of the concave tack-receiving end of the upholstery tacking tool depicted in FIG. 1.
Figure 2:
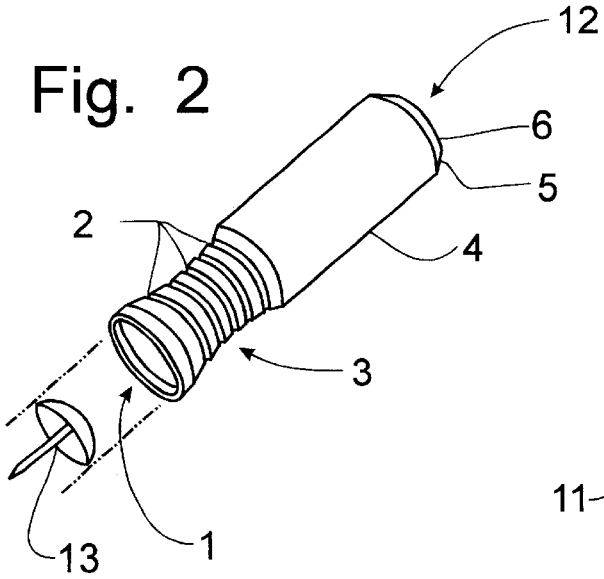
FIG. 2 is a perspective view of the upholstery tacking tool depicted in FIG. 1 showing the engagement with an representative decorative upholstery tack.
Figure 4:
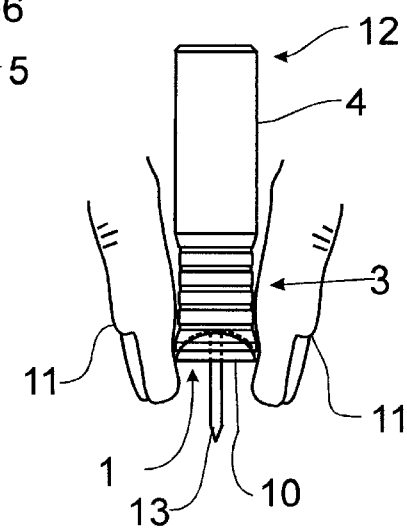
FIG. 4 is a schematic view of the simultaneous grasping of the tool and the upholstery tack to be inserted into the desired surface.

Referring now to the drawings, an upholstery tack tool incorporating the principles of the instant invention can be seen. The tool 12 is preferably formed from heat tempered steel and includes a shaft 4 that has a shape conducive to being manufactured on a lathe. The top surface 6 of the shaft 4 is flat to facilitate striking with a tack hammer and is preferably formed with a beveled edge 5. The shaft 4 also includes a concave area 3 further down the shaft 4 from the top surface 6. Preferably, the concave area 3 is formed with circumferentially oriented grooves 2 to aid in gripping the tool 12. Further away from the top surface 6, the concave area 3 flares back out to substantially the same diameter as the top surface 6 of the shaft 4 to form a small lip 7. This lip 7 distinguishes the known prior art tacking and nailing tools and defines the tack receiving portion of the shaft. The diameter of the lip 7 is less than the normal diameter of the rounded head 10 of the tack 13 so that the head 10 of the tack 13 projects outwardly of the shaft 4 to enable the operator to grasp the tool 12 and the tack 13 simultaneously.

The placement of the simple concave area 3 next to the lip 7 enables the practitioner or operator to use his fingers 11 to hold the tack 13 in place against the tack receiving concave area 1, formed longitudinally into the shaft 4 such that the lip 7 extends around the circumference thereof, to enhance control and stability for the insertion of the tack into the desired surface or object. This simple design for the upholstery tack tool 12 keeps the fingers 11 away from the top surface 6 of the tool 12 to minimize the chances of striking the fingers 11 with the tack hammer, and further keeps the tack 13 in place when driving the tack 13, thus aiding both control and speed of operation.

What is claimed is:

1. A tool for engaging an upholstery tack having a rounded head portion defining a first diameter and a pointed tack portion projecting outwardly from said head portion, comprising:

a longitudinally extending portion having a first part defining a second diameter, said first part forming a first end of said tool for striking with a hammer when being utilized for installing upholstery tacks; and means for allowing simultaneous gripping said tool and said rounded head portion of said upholstery tack, said means for allowing simultaneous gripping including a concave second part of said tool remote from said first end to define a reduced diameter grip portion terminating in a tack receiving end forming a terminus of said grip portion opposite said first end, said concave second part of said grip portion forming a lip having a third diameter, said tack receiving end having a concave end extending longitudinally into said grip portion from said lip which extends around said concave end at said terminus, said longitudinally extending concave end being formed to mate with said rounded head portion of said upholstery tack to receive a portion of said rounded head portion of said upholstery tack less than said entire rounded head portion, said third diameter of said lip extending around said tack receiving end being less than said first diameter of said rounded head portion of said upholstery tack with said longitudinally extending concave end being exposed externally so that, said rounded head projects radially outwardly of said longitudinally extending concave end though partially received within said concave end when engaged therewith, thus permitting a manual grasping of said lip and said rounded head portion of said upholstery tack simultaneously to control positioning of said upholstery tack.

2. The tool of claim 1 wherein said concave portion extends transversely into said grip portion and is formed with a plurality of grooves extending circumferentially around said tool to improve the gripping of said tool.

3. The tool of claim 2 wherein said first end is flat with a beveled edge extending circumferentially around said end.

4. The tool of claim 3 wherein said grip portion is formed as a longitudinally extending shaft having a generally cylindrical shape.

5. The tool of claim 4 wherein said grooves are spaced longitudinally along said shaft.

6. In a tool for engaging an upholstery tack having a rounded head portion defining a first diameter, said tool having a longitudinally extending axis terminating in a tack receiving end formed with a concave end corresponding to said rounded head portion of said upholstery tack and extending longitudinally into said tool, the improvement comprising:

means for allowing simultaneous gripping said tool and said rounded head portion of said upholstery tack, said means for allowing simultaneous gripping including a concave second part of said tool remote from said first end to define a reduced diameter grip portion terminating in said tack receiving end which is formed with an axially concave depression sized to receive a portion of said rounded head portion of said upholstery tack less than the entire rounded head portion, said tack receiving end further having a circumferentially extending lip defining a second diameter less than said first diameter so that said rounded head portion of said upholstery tack projects radially outwardly of said tack receiving end, said tack receiving end forming a driver for driving said upholstery tack and being exposed externally so that so that both said lip and the rounded head portion of said upholstery tack can be grasped simultaneously for placement of said tack as desired.

7. The tool of claim 6 wherein said tool is formed as a longitudinally extending shaft comprising:

a first part defining a third diameter and forming a first end of said tool opposite said concave tack receiving end, said shaft having a generally cylindrical shape with said third diameter being substantially equal to said second diameter.

8. The tool of claim 6 wherein said concave second part extends transversely and is formed with a plurality of grooves extending circumferentially around said tool to improve the gripping of said tool.

9. The tool of claim 8 wherein said grooves are spaced longitudinally along said shaft.

10. The tool of claim 9 wherein said first end is flat with a beveled edge extending circumferentially around said end.

11. A method of inserting upholstery tacks, having a rounded head portion defining a first diameter, into a structure being covered with upholstery material, comprising the steps of:

providing a tool for engaging upholstery tacks, said tool having a longitudinally extending portion including a first part defining a second diameter, said first part forming a first end of said tool for striking with a hammer when being utilized for installing upholstery tacks, a concave second part of said tool remote from said first end to define a reduced diameter grip portion terminating in a tack receiving end forming a terminus of said grip portion opposite said first end, said concave second part of said grip portion forming a lip having a third diameter, said tack receiving end further having a circumferentially extending lip defining a second diameter less than said first diameter so that said rounded head portion of said upholstery tack projects radially outwardly of said tack receiving end;

simultaneously manually grasping said tool and the portion of the rounded head of a first upholstery tack projecting radially outwardly from said tack receiving end with said rounded head being held against said tack receiving end;

aligning said upholstery tack with a selected location for inserting said upholstery tack into said structure while gripping said tool and said rounded head of said upholstery tack simultaneously with one hand;

striking said first end of said tool with a hammer to drive said upholstery tack into said structure; and releasing said tool from said rounded head of said upholstery tack to permit engagement with another upholstery tack.

12. The method of claim 11 wherein said step of simultaneously grasping said tool and the rounded head of an upholstery tack includes the step of:

gripping said tool at a concave grip portion extending circumferentially around a longitudinally extending shaft forming said tool, said concave grip portion being located adjacent said tack receiving end.

13. The method of claim 12 further comprising the step of pressing said rounded end portion into an axially concave depression sized to receive a portion of said rounded head portion of said upholstery tack less than the entire rounded head portion.

* * * * *